US009627757B2

(12) United States Patent
Huang et al.

(10) Patent No.: US 9,627,757 B2
(45) Date of Patent: Apr. 18, 2017

(54) DUAL-BAND PRINTED MONOPOLE ANTENNA

(71) Applicant: Arcadyan Technology Corporation, Hsinchu (TW)

(72) Inventors: Chih-Yung Huang, Hsinchu (TW); Kuo-Chang Lo, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 317 days.

(21) Appl. No.: 14/333,023

(22) Filed: Jul. 16, 2014

(65) Prior Publication Data

US 2015/0194729 A1 Jul. 9, 2015

(30) Foreign Application Priority Data

Jan. 8, 2014 (TW) ..... 103100729 A

(51) Int. Cl.
*H01Q 5/371* (2015.01)

(52) U.S. Cl.
CPC ..... *H01Q 5/371* (2015.01)

(58) Field of Classification Search
CPC ..... H01Q 5/371; H01Q 9/0407; H01Q 5/0027
See application file for complete search history.

(56) References Cited

U.S. PATENT DOCUMENTS 5,926,139 A * 7/1999 Korisch ..... H01Q 1/243 343/700 MS

FOREIGN PATENT DOCUMENTS

TW I239679 B 9/2005
TW 201401649 A 1/2014

OTHER PUBLICATIONS

Office Action was issued on Sep. 4, 2015 from the TW Patent Office.(all the cited references are listed in this IDS.).

* cited by examiner

*Primary Examiner* — Graham Smith
*Assistant Examiner* — Noel Maldonado
(74) *Attorney, Agent, or Firm* — The PL Law Group, PLLC

(57) ABSTRACT

A monopole antenna is disclosed. The monopole antenna includes a grounding terminal and a transmission line extending along a first direction and including a first terminal and a feeding terminal adjacent to the grounding terminal. The monopole antenna further includes a first radiator connected to the first terminal, extending along a second direction perpendicular to the first direction and operating within a first frequency range. The first radiator has a portion with a width increasing gradually along the second direction. The monopole antenna further includes a second radiator connected to the first terminal, extending along a third direction far away from the grounding terminal, having a first included angle with the transmission line, including a plurality of turns, and operating within a second frequency range.

18 Claims, 4 Drawing Sheets

DUAL-BAND PRINTED MONOPOLE ANTENNA

CROSS REFERENCE TO RELATED APPLICATIONS

The application claims the benefit of Taiwan Patent Application No. 103100729, filed on Jan. 8, 2014, at the Taiwan Intellectual Property Office, the disclosures of which are incorporated herein in their entirety by reference.

FIELD OF THE INVENTION

The present application relates to a dual-band monopole antenna, particularly to a downsized dual-band monopole antenna used on a printed circuit board.

BACKGROUND OF THE INVENTION

In past years, as handheld electronic devices became smaller, it is desired to downsize antennas used in handheld electronic devices, e.g. mobile phones, notebooks, access points (AP) or wireless transmitting devices. The developed antennas are operable for the IEEE 802.11 standard including 802.11a operating in the 5-GHz band, and 802.11b and 802.11g operating in the 2.4-GHz band.

Monopole antennas and planar inverse-F antennas (PIFA) are two of the most widely-used antennas in handheld electronic devices. Please refer to FIG. 1, which is a diagram showing a conventional PIFA. In FIG. 1, the inverse-F antenna 10 includes a ground terminal 101, a first radiator 102, a second radiator 103 and a long side $L_1$. The first radiator 102 and the second radiator 103 are used to radiate electromagnetic wave signals in different frequency ranges. Because the inverse-F antenna 10 includes the ground terminal 101, it is easy to adjust its impedance matching. In addition, the inverse-F antenna 10 is commonly used in modern handheld electronic devices because they are advantageous in their simplicity in structure and have good transmission performance.

Monopole antennas are half the size of their dipole counterparts, and hence are attractive when a smaller antenna is needed. Although monopole antennas have a smaller size than the inverse-F antennas because no ground terminal is required, but monopole antennas have a disadvantage of less adjustable variants and thus less flexibility in the matching adjustment due to the lack of the ground terminal. In addition, the conventional antennas, such as PIFA, are usually made of iron sheets, and the signals thereof are usually fed by cables, which may cause high cost for die and iron materials.

To overcome these problems, a novel dual-band printed monopole antenna is disclosed in the present disclosure after a great deal of research, analysis and experiments by the inventors.

SUMMARY OF THE INVENTION

In accordance with one aspect of the present disclosure, a monopole antenna is disclosed. The monopole antenna includes a grounding terminal and a transmission line extending along a first direction. The transmission line includes a first terminal and a feeding terminal adjacent to the grounding terminal. The monopole antenna further includes a first radiator connected to the first terminal, extending along a second direction perpendicular to the first direction and operating within a first frequency range. The first radiator has a portion with a width increasing gradually along the second direction. The monopole antenna further includes a second radiator connected to the first terminal, extending along a third direction far away from the grounding terminal, having a first included angle with the transmission line, including a plurality of turns, and operating within a second frequency range.

In accordance with another aspect of the present disclosure, a monopole antenna is disclosed. The monopole antenna includes a first radiator including a first terminal and operating within a first frequency range, and a second radiator connected to the first terminal and operating within a second frequency range. The first radiator has a portion with a width increasing gradually along a specific direction, and the second radiator has a plurality of turns.

In accordance with a further aspect of the present disclosure, a monopole antenna is disclosed. The monopole antenna includes a transmission line including a first terminal and a feeding terminal, a first radiator connected to the first terminal and operating within a first frequency range, and a second radiator connected to the first terminal and operating within a second frequency range. The second radiator has an R-like shape.

The objectives and advantages of the present disclosure will become more readily apparent to those ordinarily skilled in the art after reviewing the following detailed descriptions and accompanying drawings, in which:

DETAILED DESCRIPTION OF THE PREFERRED EMBODIMENTS

The present disclosure will now be described more specifically with reference to the following embodiments. It is to be noted that the following descriptions of preferred embodiments in this disclosure are presented herein for the purposes of illustration and description only; it is not intended to be exhaustive or to be limited to the precise form disclosed.

Figure 1:
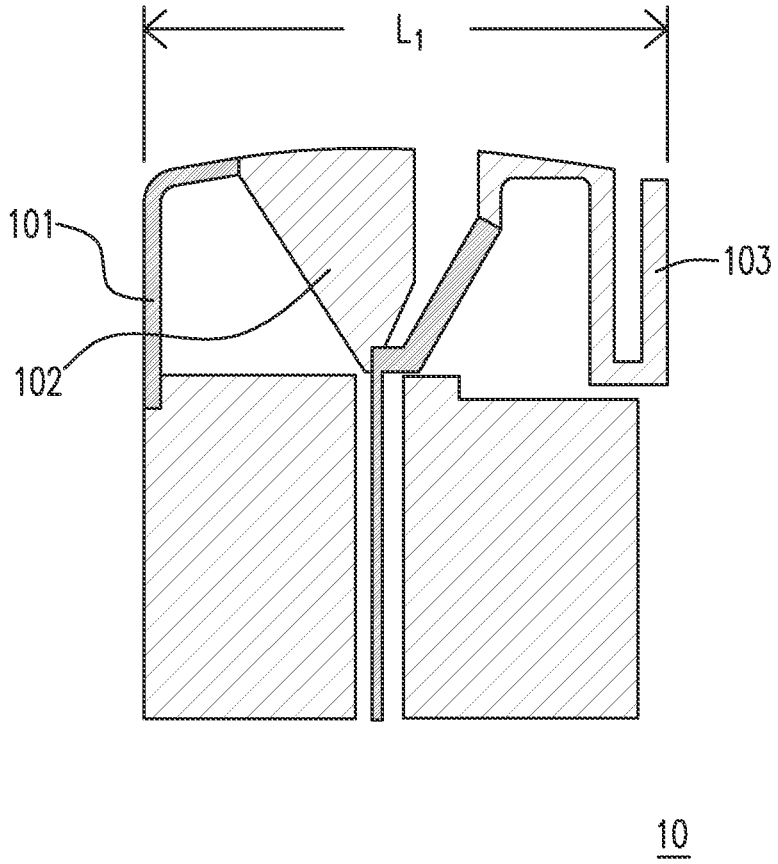
Fig. 1(Prior Art)
FIG. 1 is a diagram showing an antenna device according to the prior art.
Figure 2:
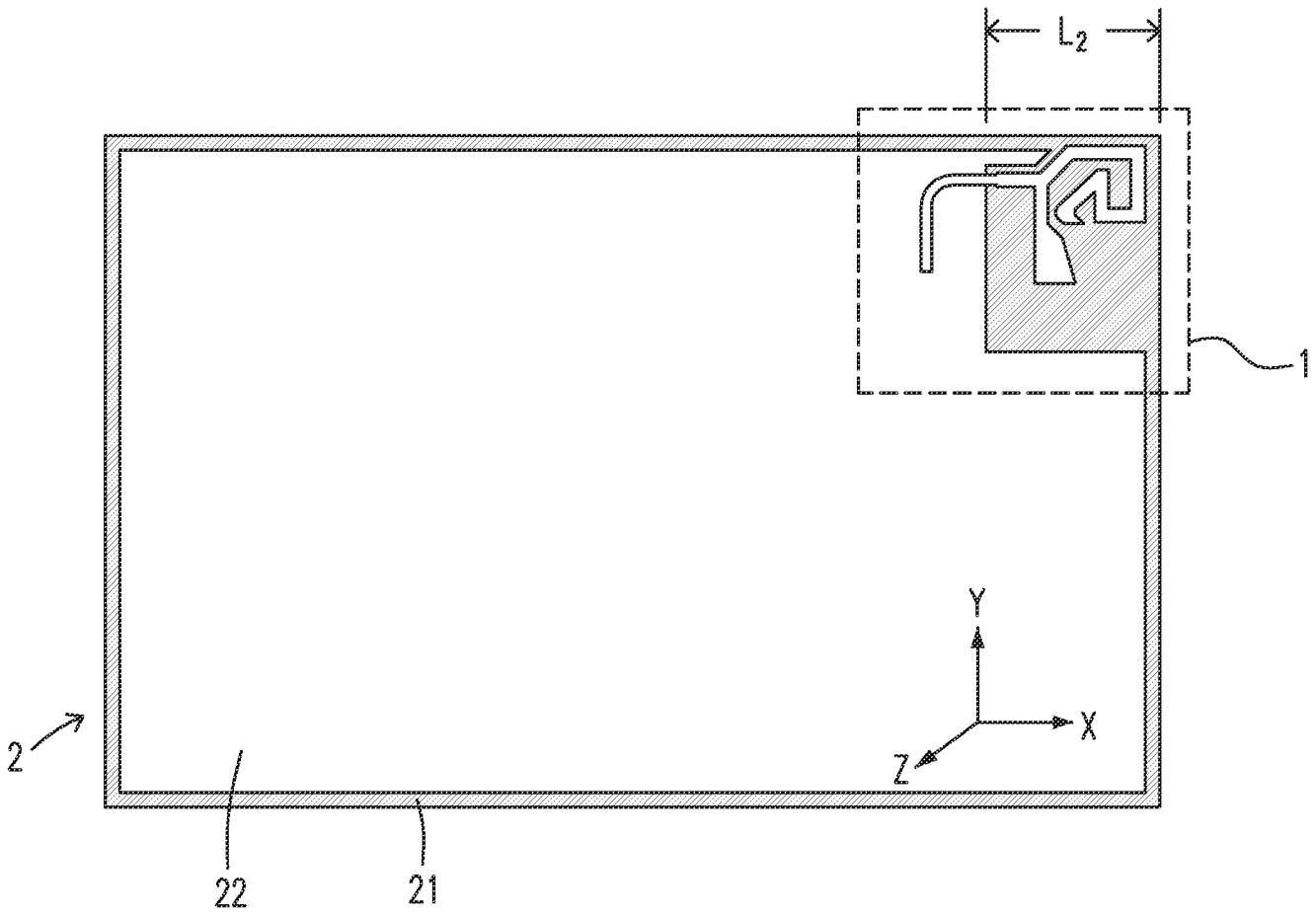
FIG. 2 is a diagram showing a dual-band printed monopole antenna configured on a printed circuit board.
Figure 3:
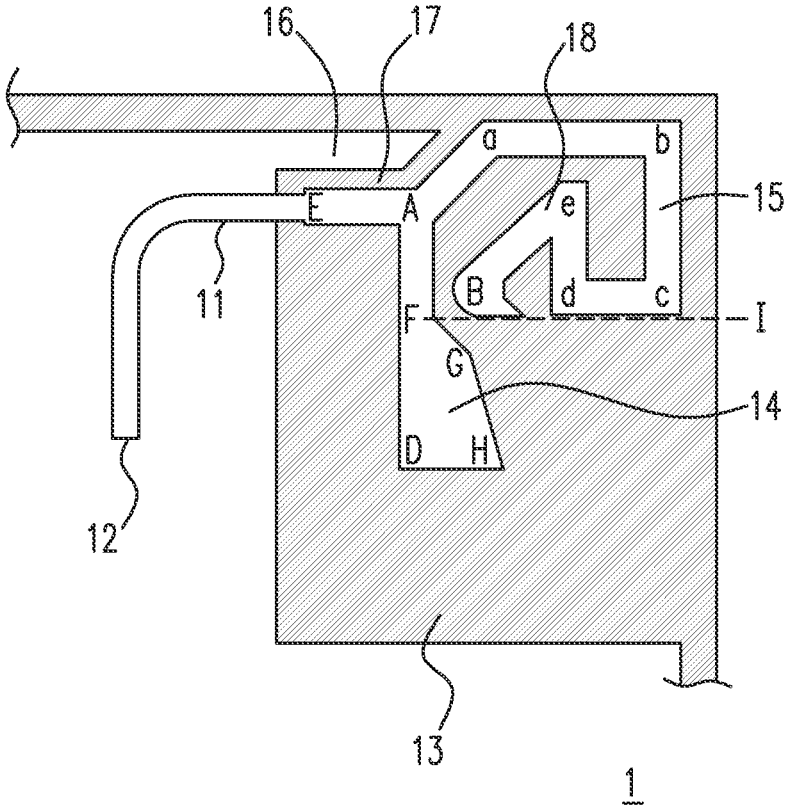
FIG. 3 is a diagram showing a portion in FIG. 2.

A preferred embodiment according to the present disclosure is detailed by FIGS. 2 and 3. Please refer to FIG. 2, which shows a dual-band printed monopole antenna 1 printed on a printed circuit board 2. The printed circuit board 2 includes a dielectric portion 21 and a metallic coating 22 on the dielectric portion 21. The dual-band printed monopole antenna 1 has a long side $L_2$. The metallic coating 22 is a grounding plane for the dual-band printed monopole antenna 1.

FIG. 3 shows details of a portion of the dual-band printed monopole antenna 1 in FIG. 2. As shown in FIG. 3, the dual-band printed monopole antenna 1 includes a transmission line 11, a feeding terminal 12, a dielectric substrate 13 of a printed circuit board (PCB), a first radiator 14, a second radiator 15, an impedance matching structure 16 and a gap 17 between the impedance matching structure 16 and the transmission line 11.

The transmission line 11 extends on the dielectric substrate 13 along a first direction, and the first radiator 14 extends on the dielectric substrate 13 along a second direction approximately perpendicular to the first direction. The feeding terminal 12 is connected to the transmission line 11 and adjacent to a grounding terminal (not shown). The extension from the feeding terminal 12 may depend on product type without being limited by the layout shown in FIG. 3. The transmission line 11 and the feeding terminal 12 have a characteristic impedance preferably being 50 ohm (Ω) to obtain better efficiency.

The impedance matching structure 16, which is connected to the grounding plane (i.e. the metallic coating 22 in FIG. 2), and the transmission line 11 are separated by the gap 17. Preferably, the impedance matching structure 16 is parallel to the transmission line 11. The impedance matching of the antenna 1 within the operable frequency range can be controlled by adjusting the sizes of the impedance matching structure 16 and the gap 17 to achieve an optimal voltage standing-wave ratio (VSWR).

The transmission line 11 includes a point A and point E, and the first radiator 14 includes points D, F, G and H, wherein the line segment AE (from point A to point E) and the line segment AD (from point A to point D) intersect at point A and are approximately perpendicular to each other, as shown in FIG. 3. The line segment AD of the first radiator 14 can be used to adjust the impedance matching of the frequency band. The perpendicular distance from the point F to the impedance matching structure 16 is about two thirds of the perpendicular distance from point D to the impedance matching structure 16. The gradual increase in width of the first radiator 14, in which the line segment DH is the widest portion, may widen the frequency range f1 within which the first radiator 14 operates. In this embodiment, the width of the first radiator 14 gradually increases from point F toward a direction far away from the feeding terminal 12, such that there is an angle in a range of about 45°-75° between the line segment FD and the line segment FG. That is, the angle in a range of about 45°-75° is a spread angle for the increase in the width of the first radiator. In addition, there may be a further turn at the G point of the first radiator 14, to form a polygon with four vertices FGHD to increase the bandwidth of f1. In other words, the first radiator 14 includes two portions, i.e. the segment AF and the polygon with four vertices FGHD. The segment AF may have a constant width. The polygon has a width gradually increasing in a direction perpendicular to the transmission line 11 by at least one spread angle in a range of about 45°-75°. The length of the line segment AD is generally equal to ¼ of a resonant wavelength λ1 of the frequency range f1 to be designed. In this way, the polygon with four vertices FGHD can be a radiator responsible for the radiation at the frequency band to generate signals within the frequency range f1.

The second radiator 15 connected to point A of the transmission line 11 has a plurality of turns, which form a R-like structure to reduce the occupied area and adjust the impedance matching of the antenna 1. In the R-like structure, points a, b, c, d, e and B are defined. The line segment Aa running in a third direction far away from the feeding terminal 12 intersects the line segment AE at an angle in a range of about 100°-150°. The line segment ab is roughly aligned with the impedance matching structure 16. The line segment bc, which may be roughly parallel to the line segment AD, may have a length equal to or less than two thirds of the perpendicular distance from point D to the impedance matching structure 16, to reduce the interactive interference of the signals from the first radiator 14. The subsequent turning directions of the second radiator 15 may be designed to be roughly parallel to one of the first direction, the second direction or the third direction. For example, the line segment cd may be roughly parallel to the line segment ab or AE; the line segment de may be roughly parallel to the line segment bc or AD; and the line segment eB may be roughly parallel to the line segment Aa. Preferably, the overall layout of the second radiator 15 does not go beyond the virtual line FI roughly perpendicular to the line segment AD, to reduce the interference between the second radiator 15 and the first radiator 14. The second radiator 15 has a hook-like structure at the terminal B point to obtain better performance. The hook-like structure is close to or adjacent to the first radiator 14. In FIG. 3, the length of the bending structure of the second radiator 15 from point A to the point B is roughly equal to ¼ of a resonant wavelength λ2 of the frequency range f2 to be designed. In this way, the bending structure can be a radiator responsible for the radiation at the frequency band to generate signals in the frequency range f2. The frequency range f1 has an operating frequency being higher than that of the frequency range f2. Specifically, high frequency current signals fed into the transmission line 11 are transformed into electromagnetic wave signals within the frequency range f1 by the first radiator 14, and the fed low frequency current signals are transformed into electromagnetic wave signals within the frequency range f2 by the second radiator 15, and thereby the antenna can operate in dual frequency bands.

Figure 4:
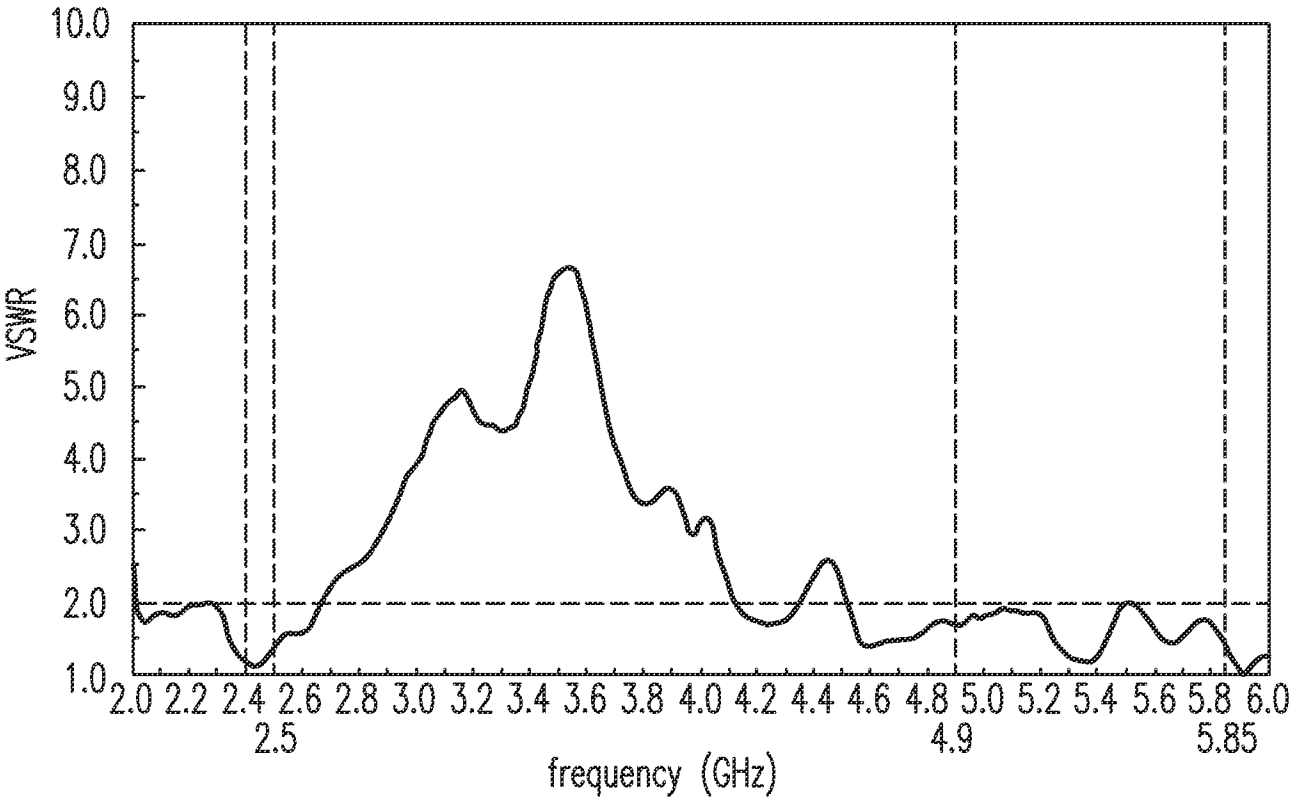
FIG. 4 shows variation of VSWR with frequency (GHz) according to the present disclosure.

FIG. 4 shows variation of VSWR with frequency (GHz) according to the present disclosure. The smaller the VSWR is, the better the antenna is matched to the transmission line and the more power is delivered to the antenna. In general, if the VSWR is under 2, the antenna match is considered very good and little would be gained by impedance matching. As shown in FIG. 4, it can be seen that the VSWR is less than 2 for the frequency range f2 of 2.00 GHz-2.60 GHz (bandwidth 400 MHz) and the frequency range f1 of 4.90 GHz-5.85 GHz (bandwidth 1800 MHz). These two frequency bands completely cover the bands in compliance with 802.11a/b/g standards.

The monopole dual-band antenna according to the embodiments of the present disclosure has an extended conductor structure including a first radiator and a second radiator, which has the advantage of downsizing the required area on the PCB and an increased bandwidth for the high frequency signals. Specifically, the antenna according to the embodiments of the present disclosure provides a vast coverage range for the electromagnetic waves with a reduction in the long side by about 30% compared to that of the conventional FIFA, and thereby the saved space can be used for other applications. In addition, the absence of the feeding cable and iron sheet not only realize downsizing of the antenna for various electronic devices, but also reduce the cost for die and iron materials.

Some embodiments of the present disclosure are described as follows.

1. A monopole antenna comprises a grounding terminal; a transmission line extending along a first direction and including a first terminal and a feeding terminal adjacent to the grounding terminal; a first radiator connected to the first terminal, extending along a second direction perpendicular to the first direction and operating within a first frequency range; and a second radiator connected to the first terminal, extending along a third direction far away from the grounding terminal, having a first included angle with the transmission line, including a plurality of turns, and operating within a second frequency range. The first radiator has a portion with a width increasing gradually along the second direction.

2. The monopole antenna of Embodiment 1, wherein the first frequency range has an operating frequency being higher than that of the second frequency range.

3. The monopole antenna of any one of the above embodiments, further comprising an impedance matching structure separated from the transmission line by a gap.

4. The monopole antenna of any one of the above embodiments, wherein the impedance matching structure is parallel to the transmission line.

5. The monopole antenna of any one of the above embodiments, wherein the plurality of turns have a plurality of turning directions, and at least one of the plurality of turning directions is one selected from a group consisting of the first direction, the second direction and the third direction.

6. The monopole antenna of any one of the above embodiments, wherein the plurality of turns have a plurality of turning directions, and each of the plurality of turning directions is parallel to one selected from a group consisting of the first direction, the second direction and the third direction.

7. The monopole antenna of any one of the above embodiments, wherein the second radiator further includes a connecting terminal connected to the first terminal, and a radiating terminal configured adjacent to the first radiator.

8. The monopole antenna of any one of the above embodiments, further comprising a grounding plane connected to the impedance matching structure, wherein the grounding plane is configured adjacent to the transmission line and the feeding terminal.

9. The monopole antenna of any one of the above embodiments, wherein the first included angle is in a range of 100°-150°.

10. The monopole antenna of any one of the above embodiments, wherein the width of the portion of the first radiator is increased along the second direction with a spread angle in a range of 45°-75°.

11. The monopole antenna of any one of the above embodiments, wherein the first radiator has a length equal to ¼ of a resonant wavelength of the first frequency range.

12. The monopole antenna of any one of the above embodiments, wherein the second radiator has a length equal to ¼ of a resonant wavelength of the second frequency range.

13. A monopole antenna comprises a first radiator including a first terminal and operating within a first frequency range; and a second radiator connected to the first terminal and operating within a second frequency range. The first radiator has a portion with a width increasing gradually along a specific direction, and the second radiator has a plurality of turns.

14. The monopole antenna of Embodiment 13, wherein the first frequency range has an operating frequency being higher than that of the second frequency range.

15. The monopole antenna of any one of Embodiments 13-14, wherein the second radiator has an R-like shape formed by the plurality of turns.

16. The monopole antenna of any one of Embodiments 13-15, wherein the monopole antenna is a printed monopole antenna.

17. A monopole antenna comprises a transmission line including a first terminal and a feeding terminal; a first radiator connected to the first terminal and operating within a first frequency range; and a second radiator connected to the first terminal and operating within a second frequency range. The second radiator has an R-like shape.

18. The monopole antenna of Embodiment 17, wherein the first radiator includes a first portion with a constant width and a second portion with a width increasing gradually along a specific direction, and the first radiator is connected to the first terminal via the first portion.

19. The monopole antenna of any one of Embodiments 17-18, wherein the specific direction is perpendicular to the transmission line.

20. The monopole antenna of any one of Embodiments 17-19, wherein the second radiator includes a connecting terminal connected to the first terminal, and a hook-shaped terminal.

While the disclosures here describe the terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A monopole antenna, comprising:

a transmission line extending along a first direction and including a first terminal and a feeding terminal;

a first radiator connected to the first terminal, extending along a second direction perpendicular to the first direction and operating within a first frequency range, wherein the first radiator has a segment and a polygon portion with a width increasing gradually along the second direction; and a second radiator connected to the first terminal, extending along a third direction far away from the feeding terminal, including a first included angle with the transmission line, having a plurality of turns two adjacent ones of which have an acute angle, and operating within a second frequency ranger, wherein the first included angle is an obtuse angle and the first terminal, the first radiator and the second radiator are disposed on the same plane.

2. The monopole antenna of claim 1, wherein the first frequency range has an operating frequency higher than that of the second frequency range.

3. The monopole antenna of claim 1, further comprising an impedance matching structure separated from the transmission line by a gap.

4. The monopole antenna of claim 3, wherein the impedance matching structure is parallel to the transmission line.

5. The monopole antenna of claim 1, wherein the plurality of turns have a plurality of turning directions, and at least one of the plurality of turning directions is one selected from a group consisting of the first direction, the second direction and the third direction.

6. The monopole antenna of claim 1, wherein the plurality of turns have a plurality of turning directions, and each of the plurality of turning directions is parallel to one selected from a group consisting of the first direction, the second direction and the third direction.

7. The monopole antenna of claim 1, further comprising a grounding plane connected to the impedance matching structure, wherein the grounding plane is configured adjacent to the transmission line and the feeding terminal.

8. The monopole antenna of claim 1, wherein the first included angle is in a range of 100°-150°.

9. The monopole antenna of claim 1, wherein the width of the portion of the first radiator is increased along the second direction with a spread angle in a range of 45°-75°.

10. The monopole antenna of claim 1, wherein the first radiator has a length equal to ¼ of a resonant wavelength of the first frequency range.

11. The monopole antenna of claim 1, wherein the second radiator has a length equal to ¼ of a resonant wavelength of the second frequency range.

12. A monopole antenna, comprising:

a dielectric substrate;

a transmission line disposed on the substrate and extending in a first direction;

a first radiator disposed on the substrate, extending in a second direction perpendicular to the first direction, including a first terminal and operating within a first frequency range; wherein the second direction is; and a second radiator disposed on the substrate, extending in a third direction, connected to the first terminal and operating within a second frequency range, wherein the first radiator has a portion with a width increasing gradually along a specific direction, and the second radiator forms with the transmission line an obtuse angle and has a plurality of turns, wherein the plurality of turns have two adjacent ones including an acute angle.

13. The monopole antenna of claim 12, wherein the first frequency range has an operating frequency higher than that of the second frequency range.

14. The monopole antenna of claim 12, wherein the second radiator has an R-like shape formed by the plurality of turns.

15. The monopole antenna of claim 12, wherein the monopole antenna is a printed monopole antenna.

16. A monopole antenna, comprising:

a transmission line including a first terminal and a feeding terminal;

a first radiator having a first portion connected to the first terminal and a second portion, and operating within a first frequency range; and a second radiator connected to the first terminal and operating within a second frequency range, wherein the second radiator has an R-like shape structure including a hook-shaped terminal at an end thereof; and an impedance matching structure separated from the transmission line by a gap.

17. The monopole antenna of claim 16, wherein the first portion has a constant width, the second portion has a width increasing gradually along a specific direction, and the first radiator is connected to the first terminal via the first portion.

18. The monopole antenna of claim 17, wherein the specific direction is perpendicular to the transmission line.

* * * * *